United States Patent [19]

Kamijima

[11] Patent Number: 4,890,528

[45] Date of Patent: Jan. 2, 1990

[54] MUSIC BOX HAVING A GENERATOR

[75] Inventor: Tadashi Kamijima, Nagano, Japan

[73] Assignee: Kabushiki Kaisha Sankyo Seiki Seisakusho, Nagano, Japan

[21] Appl. No.: 205,441

[22] Filed: Jun. 10, 1988

[30] Foreign Application Priority Data

Jun. 15, 1987 [JP] Japan ..... 62-90801[U]
Jun. 17, 1987 [JP] Japan ..... 62-91999[U]

[51] Int. Cl.[4] ..... G10F 1/06
[52] U.S. Cl. ..... 84/95.2
[58] Field of Search ..... 84/94.1, 94.2, 95.1, 84/95.2

[56] References Cited

U.S. PATENT DOCUMENTS 4,557,173 12/1985 Isaka ..... 84/95.1
4,777,394 10/1988 Hayashi ..... 310/83

FOREIGN PATENT DOCUMENTS 55-35570A 3/1980 Japan .
16439 4/1898 Switzerland ..... 84/95.1
297876 6/1954 Switzerland ..... 84/95.1
301845 9/1954 Switzerland ..... 84/95.1
1113354 5/1968 United Kingdom ..... 84/95.1

*Primary Examiner*—L. T. Hix
*Assistant Examiner*—Brian W. Brown
*Attorney, Agent, or Firm*—Flynn, Thiel, Boutell & Tanis

[57] ABSTRACT

A music box having an electricity generating function includes a mechanism for using a stored energy of a spiral spring to drive a drum at an increased speed via a worm shaft, an annular magnet fixed on the worm shaft and an electricity-generating coil opposed to the outer circumferential margin of the magnet to generate electricity in a non-contacting configuration so that the energy of the spiral spring is used to not only play music but also generate electricity.

8 Claims, 4 Drawing Sheets

MUSIC BOX HAVING A GENERATOR

FIELD OF THE INVENTION

This invention relates to a music box having the same arrangement as a prior art music box but configured to be driven by a spiral spring to not only play music but also generate an electricity.

BACKGROUND OF THE INVENTION

As one of systems of this type, Japanese Utility Model Laying-Open Publication No. 55-35570 entitled "Music Box Having A Rythm-responsive Flickering Lamp" is configured to generate an electricity simultaneously with playing music. Since the music box has a coil secured to a rotary shaft of its rotaty member, it has an acceptable electricity-generating function. However, in order to connect the rotary coil to a circuit, it requires a brush or other arrangement. This produces a noise which is an obstruction to the music played by the music box. Further, the music box is configured to play the music at an optimum speed when a lamp circuit or other load is conected to the coil. Therefore, when no load is connected, the music box is very small in speed control effect because the spiral spring is released merely under a control of the inertia of the rotary shaft with or without an addition of magnetic attraction power. As a result, the music is played at a very high speed, and the stored energy of the spiral spring is exhausted in a short time. This causes that the play does not provide an expected melody and that a pin of a drum hits a vibration flap violently and damages the flap. Beside this, a music box in general is manufactured by first completing the major body thereof and subsequently incorporating various attachments therein. During the manufacturing process of the major body, a test play is required by winding the spiral spring. However, since the above-described prior art music box has a very poor speed control function unless the magnet and the lamp circuit are connected, such a test play is almost impossible.

OBJECT OF THE INVENTION

It is therefore an object of the invention to provide a music box capable of generating an electricity and playing music without inviting a noise.

A further object of the invention is to provide a music box capable of playing music also when a lamp circuit or other load is not connected and capable of effecting a test play with the major body thereof before incorporating a generator coil.

SUMMARY OF THE INVENTION

In a music box including a damping assembly provided on a worm shaft rotatable at an increased speed to controllingly discharge the stored energy of a spiral spring to rotate a drum at a controlled speed, an invention arrangement is characterized in that an annular magnet is secured on the worm shaft, that a generator coil having a yoke opposed to the outer circumference of the annular magnet is secured to the music box and that the annular magnet and the damping assembly are secured to the worm shaft.

DETAILED DESCRIPTION

Figure 1:
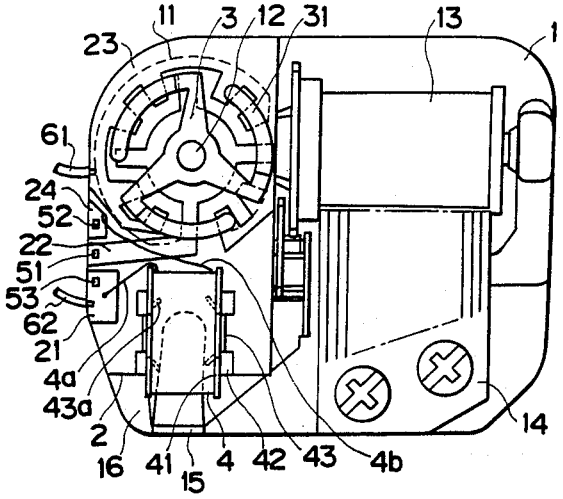
FIG. 1 is a plan view of a first embodiment of the invention.
Figure 2:
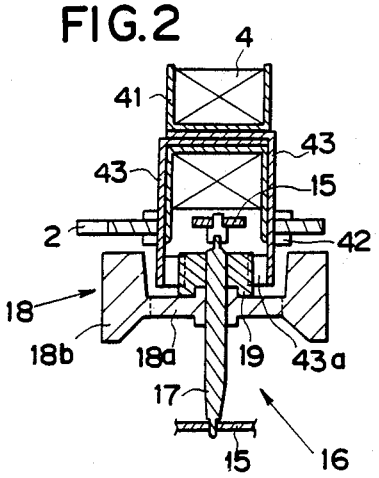
FIG. 2 is a fragmentary cross-sectional view of the system of FIG. 1.

The invention is described below, taking preferred embodiments illustrated in the drawings.

FIGS. 1 through 5 show a first embodiment of the invention configured to switch a lamp circuit, using electricity generation of the music box. A spiral spring winding shaft 12 is rotatably supported by a frame 1 and a box or case 11, with its oposite ends projecting up and down and a spiral spring being held in the box 11 is shown diagrammatically at 101. The frame 1 supports a drum 13, a vibration flap 14 and a governer base plate 15 having a governing rotary member 16. The spiral spring winding shaft 12, drum 13 and governing rotary member 16 are in rotatable connection. These arrangements are identical to those of the prior art music box. However, while the governing rotary member of the prior art system uses a metal wing secured to a worm shaft 17, the governing rotary member in the inventive system has the following arrangement so as to generate electricity.

That is, the governing rotary member 16 includes a wing assembly 18 of a plastic resin and an annular magnet 19 tightly mounted on the worm shaft 17, and the wing assembly 18 consists of a disk portion 18*a* and two wings 18*b*.

Since the arrangement of the music box is identical to the prior art music box except the wing assembly 18 and the annular magnet 19 has a governing fuction, the inventive music box can be made in a prior art manufacturing process.

The spiral spring winding shaft 12 may be configured to not extend beyond the box 11, and this does not invite any substantial change in the structure of the music box itself.

A printed board 2 is subsequently fixed to the box or case 11 of the music box manufactured as described above by screws (not shown) inserted in screw holes 11*a*. In this case, the spiral spring winding shaft 12 extends through and beyond the printed board 2.

The printed board 2 has independent patterns 21, 22, 23 and 24 on the upper surface thereof. The projecting end of the shaft 12 supports a movable contact member 3 in the form of a leaf spring at a position apart from the upper surface of the printed board 2. The movable contact member 3 has three contact ends 31 which incline downwardly to slidably contact the patterns 22 and 23. The printed board 2 engages a claw member 42 of a bobbin 41 provided with a coil 4 to support the bobbin 41 which in turn supports yokes 43—43 in a light fitting contact therewith. Lower ends 43a of the yokes 43 are bent in opposite directions and opposed to the outer periphery of the annular magnet 19.

The coil 4, yokes 43—43 and annular magnet 19 form an a.c. generator. Opposite ends 4*a* and 4*b* of the coil 4 are connected to the patterns 21 and 24. A switching transistor 5 is connected at the collector 51 thereof to the pattern 22, at the base 52 thereof to the pattern 24 and at the emitter 53 thereof to the pattern 21. Further, opposite ends 61 and 62 of a lamp circuit for an LED of other light emitting element 7 are connected to the patterns 23 and 21, respectively.

Figure 3:
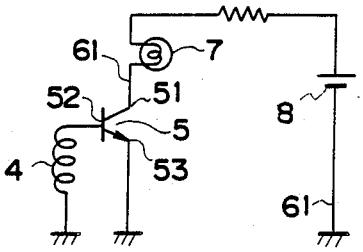
FIG. 3 is a circuit diagram.

Reference numeral 8 designates a battery which is connected in series to the light emitting element 7 and the transistor 5 via a resistor as shown in FIG. 3.

The above-explained system operates as follows.

When the shaft 12 is rotated by a stored energy of the spiral spring, the governing rotary member 16 rotates at a high speed, and the wings 18*b* and an electricity generating operation described later control the rotation speed of the shaft 12, etc. Therefore, the drum 13 rotates slowly, and the system plays music.

Simultaneously, an a.c. electromotive force is generated in the coil 4 by a responsive rotation of the magnet 19, and the electromotive force is applied between the base and emitter of the transistor 5 to switch it at the electricity generating frequency.

When the contact member 31 integral with the shaft 12 also rotates and contacts both patterns 22 and 23 during conduction of the transistor 5, the light emitting element 7 is lit, but it is not lit otherwise.

The rotation speed of the rotary member 16 is high at the beginning of the music play and low at the end thereof, and the speed is normally in the range of 6000 to 2500 rpm in most music boxes. Accordingly, the electricity generating frequency is the same as or a multiple of the value, and the on-off action of the transistor 5 does not cause flickering light of the light emitting element 7.

Figure 4:
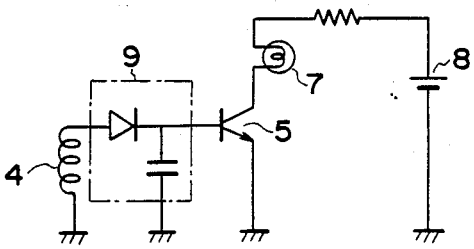
FIG. 4 is a modified circuit diagram.
Figure 5:
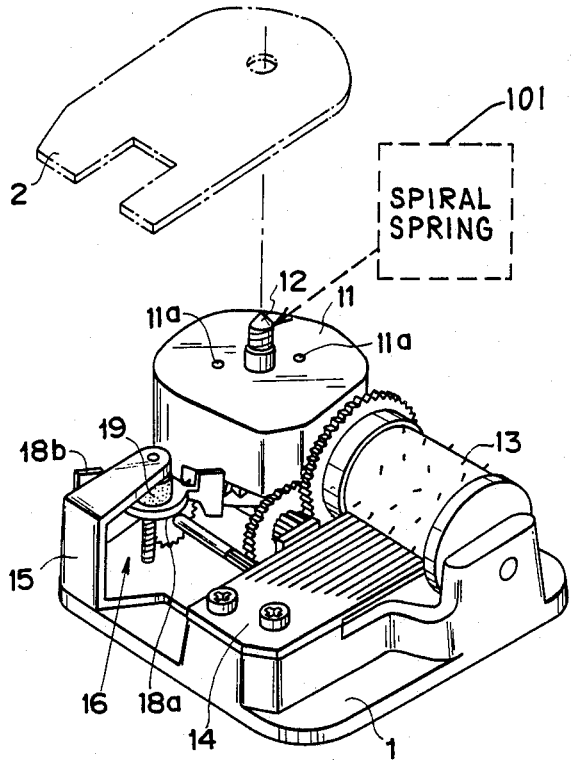
FIG. 5 is a perspective view of a music box in which a printed board is shown by an imaginary line.

A rectifier circuit 9 may be provided between the coil and the base 52 of the transistor 5 as shown in FIG. 4 to supply the transistor 5 with a d.c. voltage if a d.c. switching is required.

FIGS. 6 through 9 show a second embodiment of the invention using the electromotive force of the electricity generation to display various patterns by liquid crystal.

A music box toy is made of a music box, an a.c. generator A, a distributor B and a liquid crystal display assembly C. The music box includes a frame 1 made from a conductive material, a box 11 holding a spiral spring which is shown diagrammatically at 102, a drum 13 driven and rotated by the box 11, a governer mechanism 70 for maintaining the rotation speed of the drum 13 in a predetermined range, and a vibration flap 14 having one end closely opposed to the outer circumferential surface of the drum 13. The box 11 supports a spiral spring winding shaft 12. The drum 13 has an axle 71 which is secured to one end thereof and rotatably supported by a bearing 72. The axle 71 and the bearing 72 are both made from a conductive material. The drum 13 has a large-diameter gear 73 at the other end thereof. One end surface of the gear 73 opposed to the box 11 is provided with integral gear teeth (not shown) which engage an output gear in the box 11 to transmit a discharged power of the spiral spring to the drum 13. The drum 13 has a pins on the outer circumferential surface thereof. The pins are disposed to provide a selected piece of music and engage the vibration flap 14, respectively. The bearing 72 is secured to the frame 1.

The gear 73 engages a small-diameter gear 74*a* of a two-step gear assembly 74. A large-diameter gear 74*b* of the two-step gear assembly 74 engages a gear 76 which is integral with a worm 75. These gears are all supported rotatably on the frame 1. The worm 75 engages the worm shaft 17 having an upper end in a tight engagement with two brake shoes 77. The worm shaft 17 is supported at one end thereof by a bearing portion 1*a* of the frame 1 and at the other end thereof by a bearing 78*a* (FIG. 7) formed on a frame 78 of an a.c. generator which will be described later. The brake shoes 77 are made from rubber or other resilient material and have arcuate arm portions 77*a*–77*a* which are centrifugally expanded when the worm shaft 17 is rotated at a high speed.

Figure 6:
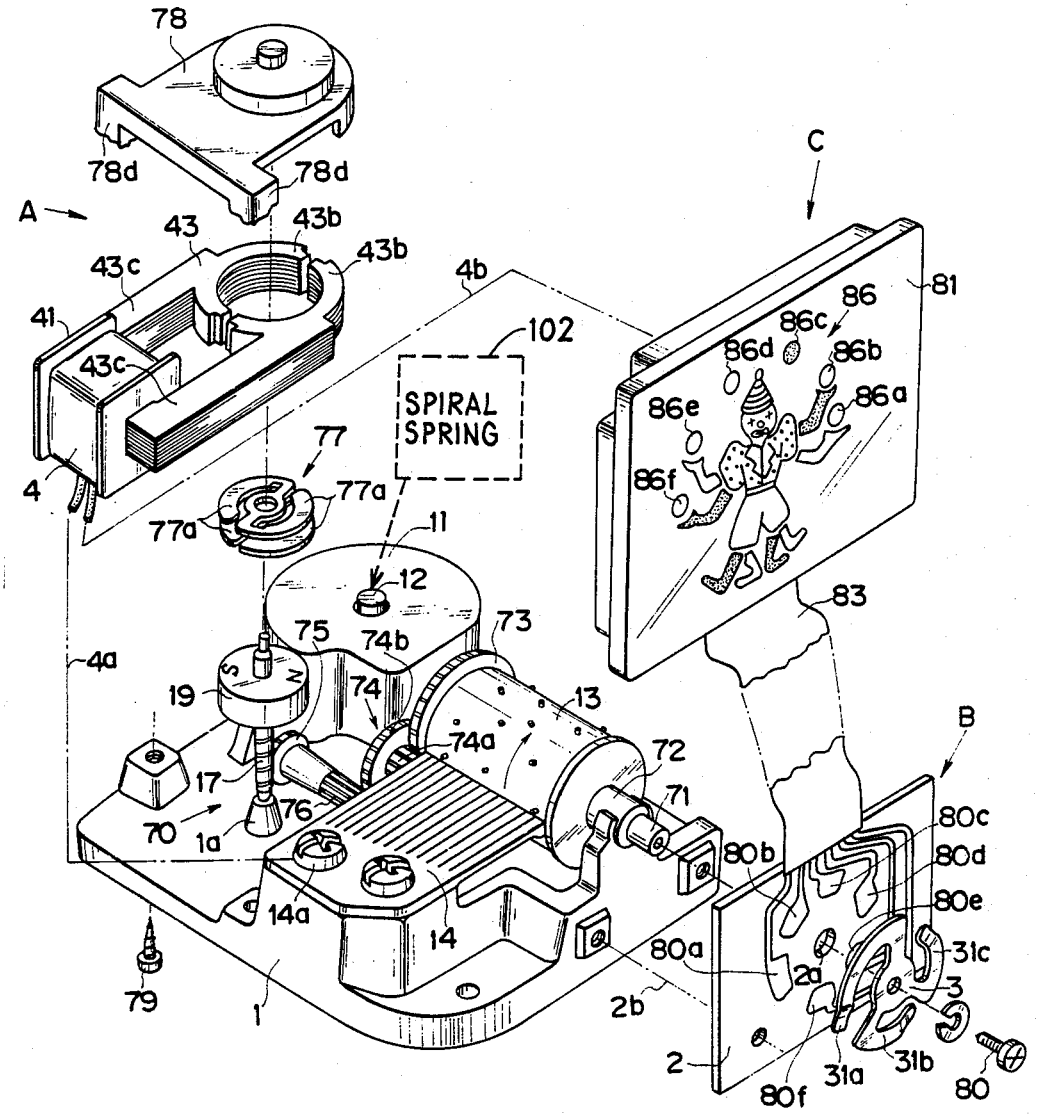
FIG. 6 is an exploded view of a second embodiment of the invention.
Figure 7:
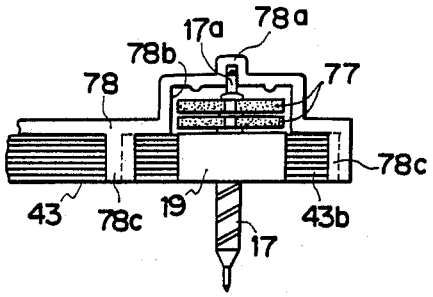
FIG. 7 is a fragmentary cross-sectional view of the system of FIG. 6.

The a.c. generator A includes an annular magnet 19 made from a permanent magnet in a tight engagement with the worm shaft 17, yokes 43—43 having semicircular portions 43*b*—43*b* encircling the annular magnet 19, a coil 4 provided on a bobbin 41 accepting core portions 43*c*—43*c* of the yokes therethrough, and a frame 78 made from an insulative material and holding the pair of yokes 43—43 in a unitary configuration. The frame 78 is fixed by a screw 79 to the frame 1 of the music box. The frame 78 includes, as shown in FIG. 7, a bearing 78a supporting one end 17*a* of the worm shaft 17, a brake assembly 78b encircling outer circumferences of the brake shoes 77—77, a holding assembly 78c holding the yokes 43—43, and legs 78*d*—78*d* (FIG. 6) for fixing the frame 78 to the music box. One lead wire 4*a* of the coil 4 is connected to the frame 1 by vibration flap fixing screws 14*a*.

The distributor B includes a printed board 2 having a hole 2*a* receiving the drum axle 71 therethrough and a movable contact member 3 fixed to the extension of the drum axle 71 by a screw 80. The printed board 2 is provided with fixed contacts 80*a*, 80*b*, 80*c*, 80*d*, 80*e* and 80*f* around the hole 2*a* and is fixed to the frame 1 by a fixture screw 2*b*. The movable contact member 3 is made from a resilient plate and is illustrated as having three contacts 3*a*, 3*b* and 3*c*. The three contacts are disposed so that when two of them contact two of the fixed contacts 80*a* through 80*f*, the other contact does not contact any of the fixed contacts.

Figure 8:
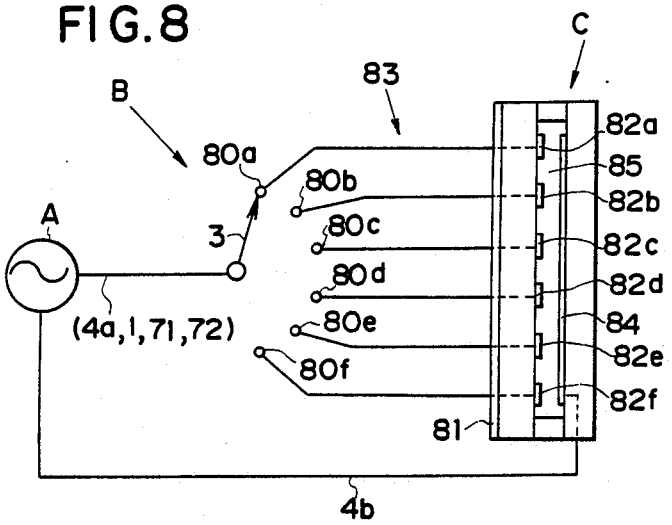
FIG. 8 is a circuit connection diagram of the system of FIG. 6.

The display assembly C consists of a liquid crystal display which includes, as shown in FIG. 8, a panel 81, a plurality of electrodes 82*a* through 82*f* disposed at positions of a figure drawn on the panel 81 and connected to the fixed contacts by a ribbon cable 83, a common electrode 84 connected to the other lead wire 4*b* of the coil 4, and liquid crystal 85 encapsuled between respective electrodes. The panel 81 is illustrated in FIG. 6 as having a figure of a pierrot who throws and catches a ball 86. The electrodes 82*a* though 82*f* are disposed at positions corresponding to different positions 86a through 86*f* of the ball 86, and the surface opposed to the panel surface is painted by a color different from that of the panel surface. The illustrated pierrot is shown as having double right and left arms and legs. Further electrodes (not shown) may be provided for these arms and legs. When a voltage is applied to one of electrodes 82*a* through 82*f* via the distributor B, the liquid crystal 85 at a position corresponding to a voltage-supplied electrode becomes transparent, and a part of the figure corresponding to the electrode is observed through the ball display portions of the panel.

The second embodiment described above operates as follows.

When the drum 13 is rotated in the arrow-marked direction by a discharged power of the spiral spring, the rotation is increased by a speed-up gear system, and the worm shaft 17 is rotated at a high speed. When the rotation of the worm shaft 17 exceeds a predetermined value, the arms 77a–77a of the brake shoes 77—77 are expanded by a centrifugal force into slidable contact with the damper portion 78b to frictionally suppress the rotation of the worm shaft 17. When the rotation of the worm shaft 17 is reduced below a predetermined value, the brake shoes come apart from the damper portion 78b. Engagement and disengagement between the brake shoes 77—77 and the damper portion 78b are repeated to maintain the rotation of the worm shaft 17 and the drum 13 in a predetermined range. As a result, the drum 13 is rotated at a substantially uniform speed, and the pins on the outer surface thereof hit the vibration flap 14 to play the music.

On the other hand, when the worm shaft 17 is rotated at a high speed, the annular magnet 19 integral therewith is also rotated, and changes the magnetic flux between the yokes 43—43 to generate an a.c. electromotive power in the coil 4. The electromotive power produced by the a.c. generator A is maintained in a substantially constant range because the rotation speed of the worm shaft 17 is maintained in a predetermined range.

Figure 9:
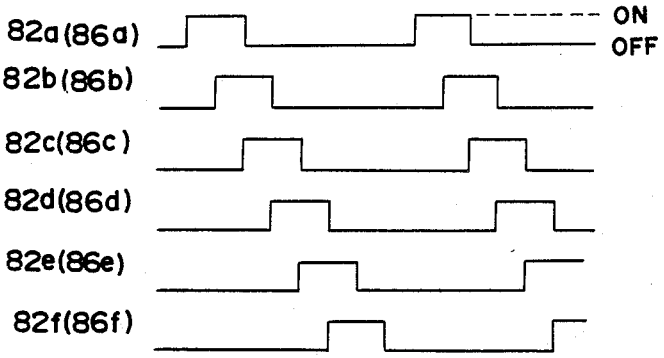
FIG. 9 shows the waveform of a signal distributed by a distributor.

When the drum 13 is rotated, the movable contact member 3 secured to the support axle 71 of the drum 13 is also rotated. As a result, the respective movable contacts are brought into sequential slidable contacts with the fixed contacts 80a through 80f, and selectively apply an a.c. voltage to the electrodes 82a through 82f associated with respective elements of the figure on the panel 81. When the distributor B applies a voltage to the electrodes 82a through 82f, the display assembly C operates as follows. In FIGS. 8 and 9, when the movable contact 3 is brought into sequential slidable contacts with the fixed contacts, the electrode 82a is first turned on, and the electrode 82b is subsequently turned on before the first electrode 82a is turned off. Just when the electrode 82a is turned off, the third electrode 82c is turned on. That is, the electrodes are turned on and off in sequence at a constant cycle, while ensuring that two adjacent ones of the electrodes take their on-positions. In this on-off actions of the electrodes, the ball 86 on the panel 81 of the display assembly C is observed as follows. In FIG. 6, the ball 86a alone is first observed. Soon after, the ball 86b is also observed together with the first ball 86a. Subsequently, when the electrode 82a is turned off, the first ball 86a disappears from the sight, and the electrode 82c is turned on to light the third ball 86c. In this fashion, the figure on the display assembly C is observed as if the pierrot throws the ball 86 by his left hand and catches it by his right hand.

It will be understood from the aforegoing description that the driving force of the spiral spring of the toy activates the system to provide a short animated movie while playing the music. The figure drawn on the panel of the display assembly C may be an animal, insect or any other character other than the illustrated example. Whatever figure is selected, it is very easy to match the movement of the figure on the display panel with the rhythm of music played by the music box, and this apparently increases the fun with the toy.

The inventive system may be modified in various points indicated below.

If the electricity-generating electromotive force of the music box is used directly as a power source, the coil bobbin may be fixed to the board, and the movable contact member and the printed board may be omitted.

The annular magnet may be configured to have a larger diameter and be fixed to the damper portion so that the yokes are opposed to the inner wall of the magnet. Further, the magnet may be in the form of a rod instead of the annular configuration, so that opposite ends thereof are opposed to the yokes.

One of the mechanical damper portion and the magnet may be fixed on the worm shaft, with the other being fixed to a gear shaft rotatable simultaneously with the worm shaft.

According to the invention, since the magnet is fixed on the worm shaft to generate an electricity in a non-contacting configuration, the system does not produce a noise, and effectively uses the power of the spiral spring to not only play the music but also generate an electricity. Further, since the rotary member functioning as a generator and a governor includes the electricity-generating magnet and the mechanical governor in the form of wind blades or brake shoes, the music box can play music also in absence of the lamp circuit or other electric load (although the rotation speed is slightly high), and a test play can be effected agaist a semi-finished music box before incorporating the electricity-generating coil.

Particularly referring to the first embodiment, the music box can play music and generate an electricity by the same arrangement as the prior art music box except the wind blades (wings) 18 and the magnet fixed on the worm shaft, and it leads to a uniformity of products and to a simplified arrangement. Besides this, since the worm shaft is provided with not only the magnet but also the wind blades, the spiral spring can be wound up in the manufacturing process before the electricity generating coil is incorporated (since the spiral spring is wound up at a final process, the drum rotates at a high speed in absence of the governing rotary member and hits the vibration flap so hard to damage the music box). Further, since the coil with yokes may be incorporated later, the manufacturing and assembling process is easy, and the dimension of the system is not increased although the coil bobbin projects slightly. Since the circuit is closed only when the music box plays music, the battery is not used when the music is not played, and this saves the power consumption.

Particularly referring to the second embodiment, since the system effects a liquid crystal display via the distributor in accordance with the music play of the music box, any desired animated figure can be displayed in synchronization with the music. Further, since an alternating current is used, the life of the liquid crystal is prolonged, and the display can be effected without using a battery.

What is claimed is:

1. A music box which can generate electricity, comprising a drive mechanism, electricity-generating means driven by said drive mechanism for generating electricity, music generating means driven by said drive mechanism for producing a sequence of audible sounds at a production speed, damper means for preventing said production speed from exceeding a predetermined speed, distributon means having a plurality of outputs and operatively coupled to said electricity-generating means for intermittently supplying electricity from said electricity-generating means to each of said outputs according to a predetermined sequence synchronized to said sequence of audible sounds, and a display assembly having a plurality of selectively actuable visible display elements which are each connected to and selectively actuated by a respective said output of said distributor means.

2. A music box according to claim 1, wherein said drive mechanism includes a rotatable drive shaft and a spiral spring which yieldably urges rotation of said drive shaft; wherein said music generating means includes a drum supported on a rotatable drum shaft which is rotated by said drive mechanism; and wherein said distributor means includes a circuit board fixed to a stationary part of said music box and having a plurality of pattern elements thereon which are each coupled to a respective one of said electricity-generating means and said outputs, and includes a contact member slidably engageable with said pattern elements and fixed to one of said drive shaft and said drum shaft.

3. A music box according to claim 1, wherein said display assembly includes a liquid crystal display and said display elements are each a respective portion of said liquid crystal display.

4. A music box according to claim 2, wherein said drive mechanism includes a rotatable worm shaft, said drive mechanism effecting rotation of said drum and said worm shaft at respective speeds, the rotational speed of said worm shaft being substantially greater than that of said drum, wherein said damper means is cooperable with said worm shaft for preventing said worm shaft from exceeding a predetermined speed, and wherein said electricity-generating means includes a magnet provided on said worm shaft and a stationary electricity-generating coil having yokes which each have a portion adjacent an outer circumferential margin of said magnet.

5. A music box according to claim 1, wherien said damper meansd includes a damper element which is fixed on said worm shaft.

6. A music box according to claim 1, wherein said magnet is provided on a circumferential surface of an integral portion of said worm shaft.

7. A music box which can generate electricity, comprising a drive mechanism, electricity-generating means driven by said drive mechanism for generating an electric signal, music generating means driven by said drive mechanism for producing a sequence of audible sounds at a production speed, damper means for preventing said production speed from exceeding a predetermined speed, and a circuit having selectively actuable transistor switching means for supplying electric power from a power source to a load, said electric signal from said electricity-generating means being supplied to said switching means to control actuation and deactuation of said switching means.

8. A music box according to claim 7, including a rectifier circuit connected between said electricity-generating means and said switching means.

* * * * *

UNITED STATES PATENT AND TRADEMARK OFFICE

CERTIFICATE OF CORRECTION

PATENT NO. : 4 890 528

DATED : January 2, 1990

INVENTOR(S) : Tadashi KAMIJIMA

It is certified that error appears in the above-identified patent and that said Letters Patent is hereby corrected as shown below:

Column 6, line 65; change "distributon" to ---distributor---.

Column 8, line 7; change "wherien" to ---wherein---.

change "Claim 1" to ---Claim 4---.

line 8; change "meansd" to ---means---.

line 10; change "Claim 1" to ---Claim 4---.

Signed and Sealed this

First Day of January, 1991

*Attest:*

HARRY F. MANBECK, JR.

*Attesting Officer*

*Commissioner of Patents and Trademarks*